US005722125A

United States Patent [19]

Vasilopoulos

[11] Patent Number: 5,722,125

[45] Date of Patent: Mar. 3, 1998

[54] SECURING DEVICE FOR GOLF CLUB HEAD COVERS

[76] Inventor: Peter Vasilopoulos, 11831 SE. Tiffany Way, Tequesta, Fla. 33469

[21] Appl. No.: 768,785

[22] Filed: Dec. 17, 1996

[51] Int. Cl.[6] ..... A44B 21/00; A63B 55/00

[52] U.S. Cl. ..... 24/301; 24/3.13; 24/300; 150/160

[58] Field of Search ..... 24/300, 301, 908, 24/905, 3.13; 224/643, 644; 150/159, 160; 206/315.4

[56] References Cited

U.S. PATENT DOCUMENTS

| | | | |
|---|---|---|---|
| 452,830 | 5/1891 | Bowie et al. | 24/3.13 |
| 2,849,776 | 9/1958 | Bahr | 24/908 |
| 2,994,300 | 8/1961 | Grahling | 24/300 |
| 3,638,284 | 2/1972 | Baker | 150/160 |
| 3,821,976 | 7/1974 | Smith et al. | 150/160 |
| 4,625,862 | 12/1986 | Clayton | 224/932 |
| 4,901,406 | 2/1990 | Shelby et al. | 24/3.13 |
| 5,117,884 | 6/1992 | Diener et al. | 150/160 |

*Primary Examiner*—Victor N. Sakran
*Attorney, Agent, or Firm*—Robert M. Downey, PA

[57] ABSTRACT

A device to secure golf club head covers to a golf bag includes a base ring member, a clip fitted to the base ring, and being structured for removable attachment to the golf bag, one or more elastomeric cords having a proximal end secured to the base ring with a swivel fitting and a distal end zone including a hook element fitted thereto with a swivel fitting for removable attachment of the cord to a respective one of the head covers, wherein the head covers, when removed from corresponding golf clubs, remain interconnected to the device and the golf bag so that they do not become separated therefrom and possibly misplaced or lost. One or more alligator clips or like fittings may be provided on the base ring for hanging a hat, glove, or other article therefrom.

18 Claims, 1 Drawing Sheet

SECURING DEVICE FOR GOLF CLUB HEAD COVERS

FIELD OF THE INVENTION

The present invention relates to devices for interconnecting golf club head covers and, more specifically, a device for individually securing golf club head covers to a golf bag so that the head covers remain interconnected to the golf bag when they are removed from their respective golf clubs.

BACKGROUND OF THE INVENTION

A typical set of golf clubs, carried in a golf bag, consists of irons, a putter, and two to four woods including a driver. The woods have been given their name because the head portion of these clubs was traditionally formed of a hard wood having a lacquered and polished exterior. When carried in a golf bag, the heads of the woods tend to bang together, causing the lacquer coating and paint on the head to chip and scratch. To protect the finished surface of the heads on woods, many golfers have used head covers made of leather or knitted fabric which, much like a sock, slip over the heads of the woods. Roman numerals are often provided on the head covers to identify the number of the wood (i.e., driver, 3 wood, 4 wood, etc.) that they cover.

Now, most woods are, in fact, made of non-wood compositions such as metal alloys and/or graphite compositions. Still, the heads tend to become scratched and chipped over time from banging into each other when the golf bag is carried. Also, the heads can become scratched if the golf bag is dropped or falls against a hard ground surface or other object. Also, the irons and putter can become scratched when carried in a golf bag and, accordingly, covers have been made for these clubs as well.

When a golfer needs to use a particular club, the typical routine is to remove the club from the bag and then, if the club has a head cover, the head cover is removed. Many times, golfers will simply throw the head cover on the ground, intending to pick it up for replacement on the club after they make their golf shot. However, as is often the case, the golfer is often focused on the location of the ball or is engaged in conversation with other golfers in his/her party after making the golf shot. Facing these and other distractions, the golfer inevitably forgets to pick up the head cover at one time or another and goes on to play the next hole or holes only to discover, at some later point in time, that his/her head cover is missing.

In the past, head covers have been interconnected to each other using a string or lace which weaves through each head cover and ties at the ends to form a closed loop. While this has been a somewhat effective means to prevent loss of head covers, most golfers find it difficult to remove the head cover from one club when it is interconnected to other head covers on other golf clubs in the bag. This is particularly a problem because the club cannot be removed from the golf bag until the head cover is removed. Furthermore, the head covers are sometimes removed from all of the clubs, such as when cleaning the clubs after a round of golf. In this instance, the head covers become separated from the golf bag, and are sometimes misplaced, lost or stolen.

Accordingly, there still exists a need in the golf industry for a device which individually interconnects each head cover to the golf bag so that the head cover can be easily removed from the respective golf club without becoming separated from the golf bag.

SUMMARY OF THE INVENTION

The present invention is directed to a device to secure golf club head covers to a golf bag. The device includes a base ring member, preferably structure similar to that of a key ring, which permits other articles to be removably fitted thereto. A clip is fitted to the base ring and is structured for removable attachment to the golf bag. One or more elastomeric cords are provided, each having a proximal end secured to the base ring with a swivel fitting and a distal end zone having a hook element fitted thereto with a swivel fitting for removable attachment to a respective one of the head covers. When the device of the present invention is attached to a golf bag, and the hook elements on the cords are attached to respective head covers, any of the respective head covers can be removed from a corresponding golf club while remaining interconnected to the device and the golf bag so that they do not become separated therefrom and possibly misplaced, lost or stolen.

One or more alligator clips or like fittings may be provided on the base ring to releasably grasp a hat, glove, or other article which may be conveniently hung from the device on the side of a golf bag.

With the foregoing in mind, it is a primary object of the present invention to provide a device for securing golf club head covers to a golf bag so that individual ones of the head covers can be removed from a respective golf club and remain attached to the golf bag when the golf club is being used.

It is another object of the present invention to provide a device to secure golf club head covers to a golf bag wherein the device is designed for quick and easy attachment to the golf bag and each of the head covers.

It is still a further object of the present invention to provide a device to secure golf club head covers to a golf bag which includes a base element which removably attaches to the golf bag and a plurality of elastomeric cords extending from the base element for individual attachment to respective head covers, wherein the cords are able to stretch to an extended length when removing the head covers from golf clubs in the golf bag.

It is yet a further object of the present invention to provide a device to secure golf club head covers to a golf bag wherein the device is relatively inexpensive, yet durable and attractive.

It is still a further object of the present invention to provide a device to secure golf club head covers to a golf bag wherein the device further includes means to removably secure a hat, glove, and/or other like articles.

These and other objects and advantages of the present invention will be more readily apparent in the detailed description which follows.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENTS

Figure 1:
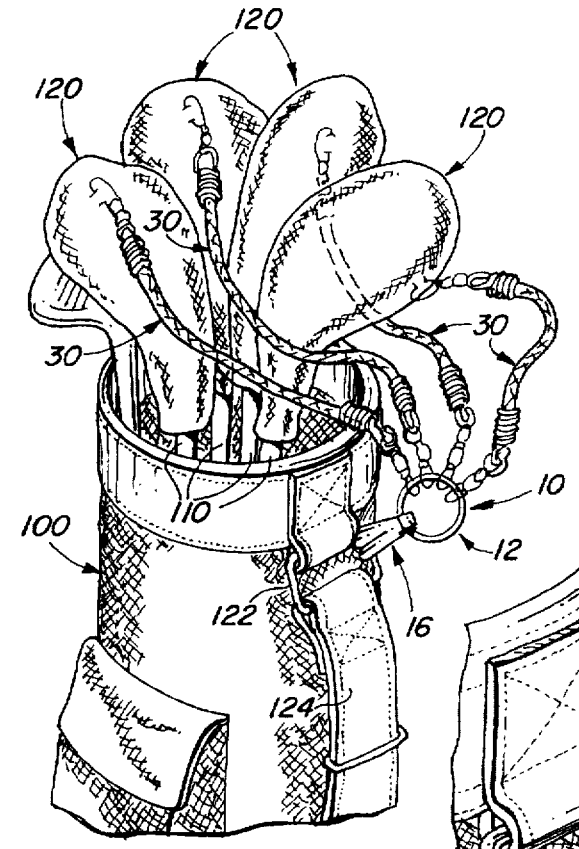
FIG. 1 is a perspective view illustrating the device of the present invention installed on a golf bag and interconnected to head covers on golf clubs carried in the golf bag.
Figure 2:
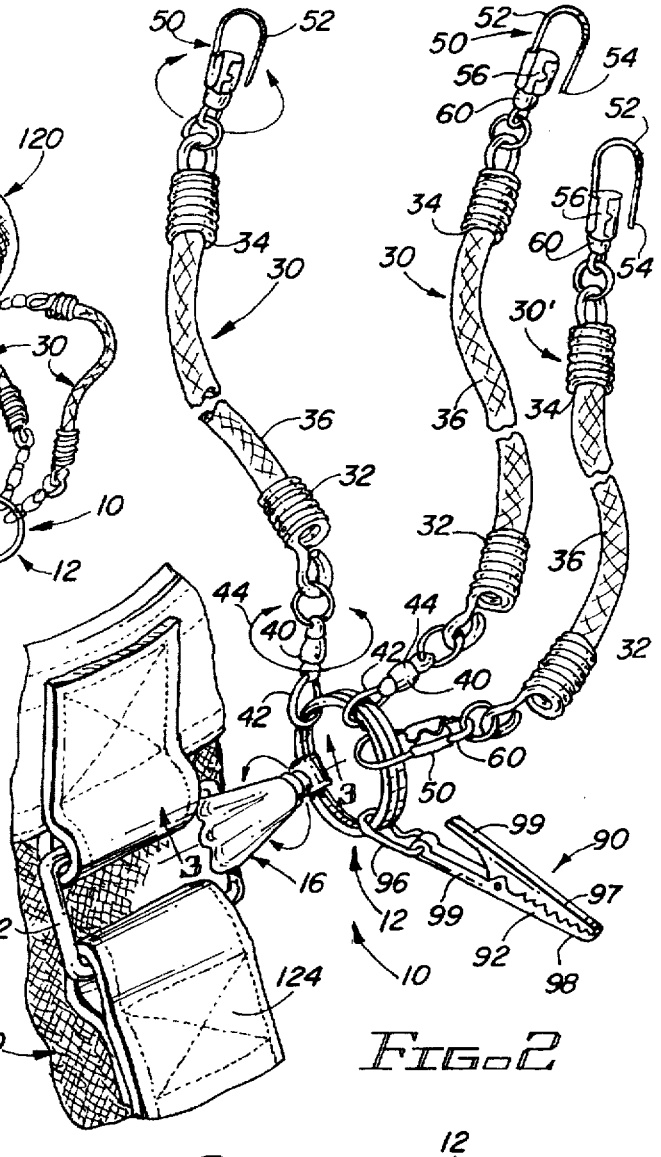
FIG. 2 is an isolated perspective view, shown in cutaway, illustrating the device of the present invention, in accordance with one preferred embodiment thereof, attached to a shoulder strap ring of a golf bag.

Referring to the several views of the drawings, and initially FIGS. 1 and 2, the present invention is directed to a device, generally indicated as 10, for use on a golf bag 100 having a plurality of golf clubs 110 therein and head covers 120 on at least some of the golf clubs 110.

The device 10 includes a base ring 12 which is preferably of a construction similar to that of a key ring. This key ring type construction consists of coiled metal band 15 having opposite ends 13, 14, (see FIG. 4) wherein either one of the ends 13, 14 is fed through an aperture or opening on articles to be fitted on the ring 12 and by rotating the base ring 12, the band 15 is received through the aperture to secure the article on the base ring 12.

Figure 3:
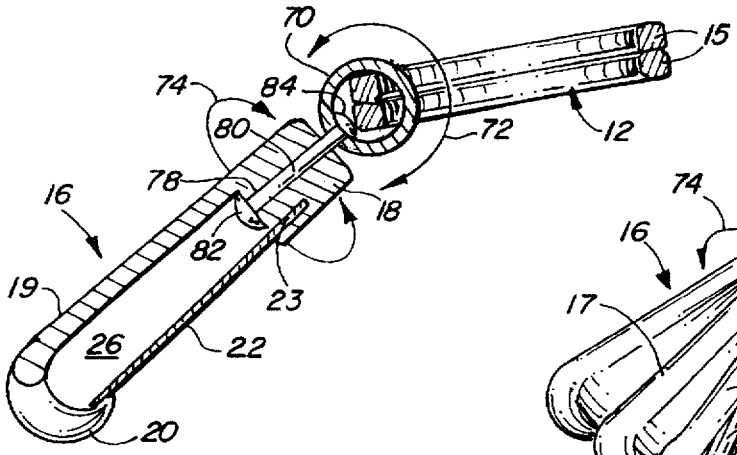
FIG. 3 is a sectional view taken along the plane of the line 3—3 of FIG. 2, illustrating a base ring and attaching clip of the present invention.

The device further includes a clip 16 having a main body 17 with a first end defining a base 18, a claw 19, and an opposite hooked end 20 at the end of the claw 19, as best illustrated in FIG. 3. A flexible, yet rigid finger element 22 is fixed at one end 23 to the base 18 of the clip and terminates at a free end 24 against the hooked end 20 of the clip 16. By pressing inwardly on the finger element 22, the free end 24 is separated from the hooked portion 20 to receive and capture an attaching member within the closure area 26 between the claw 19 and finger element 22 of the clip 16. In a preferred embodiment, the clip 16 is secured to hardware on the golf bag 100, such as a metal ring 122 attaching a shoulder strap 124 to the golf bag 100.

A plurality of generally elongate cords 30 are provided for interconnection between the head covers 120 and the base ring 12, each having a proximal end zone 32, a distal end zone 34, and a central zone 36 extending between the proximal and distal end zones 32, 34. In a preferred embodiment, the cords 30 are formed of an elastomeric material, such as bungee cord, permitting the cords 30 to be stretched from a relaxed length to an extended length upon applying tension to pull the opposite end zones away from each other. It should be noted that the length of the cords should be sufficient to extend from the base ring to each of the head covers, without stretching the cords, while the head covers remain on the clubs. When it is desirous to use a particular club, the head cover on that club can be removed, with the club remaining in the golf bag. When removing the head cover, the cord is able to stretch so that the head cover can be pulled completely from the club.

A swivel fitting 40 is provided for interconnection of the proximal end zone 32 of each of the cords to the base ring 12. The swivel fittings 40 include a ring 42 which is fitted to the base ring, in the manner described above. The swivel fittings 40 can be of the type commonly found on fishing tackle, and permit the cords 40 to spin, as indicated by arrows 44.

The opposite distal end zones 34 of the cords 30 are provided with hook means 50 for removable attachment of the cords to individual respective ones of the head covers 120, as seen in FIG. 1. The hook means 50 may be of a type found on fishing leaders, and includes a generally U-shaped wire element 52 having a relatively sharp free distal tip 54 which is able to be pierced through the head covers 120. A clasping shield 56 closes the U-shaped wire 52 and protectively conceals the distal tip 54. To secure the hook means to the head covers 120, the distal tip 54 of the U-shaped wire 52 is released from the clasping shield 56 by squeezing the wire together until the distal tip 54 is released and is urged outwardly free from the clasping shield 56, in a manner similar to safety pin. With the distal tip 54 exposed, the U-shaped wire can be pierced and fed through a respective one of the head covers 120 until the pointed distal tip 54 exits the head cover 120. The U-shaped wire element 52 is then squeezed to move the distal tip 54 within the grasp of the clasping shield 56 and, when properly aligned, is released to maintain the U-shaped wire in the closed position, securely attached to the head cover 120.

In a preferred embodiment, a swivel 60 is provided between the distal end zone 34 of the cords 30 and the hook means 50, so that, in conjunction with the swivel 40 at the proximal end zone 32, the cord 30 can spin relative to the hook means 50, head covers 120, and base ring 12 without imparting a twist to the cords.

Referring to FIG. 2, in a preferred embodiment, at least one of the cords 30' is provided with the hook means 50 at both the proximal end zone 32 and the distal end zone 34, so that the cord 30' can be easily and quickly detached from the base ring 12, at the proximal end zone 32, and attached separately to hardware on the golf bag 100, such as a zipper, independently from a remainder of the device 10. This is particularly useful when it is desirous to attach a head cover on a putter to the golf bag, so that when the putter is removed from the bag for use, the putter's head cover will not be separated from the golf bag 100. Because the putter is often situated at some distance away from a remainder of the clubs carried in the golf bag 100, it may be more convenient to attach the putter's head cover to the bag 100 at a separate place than a remainder of the device 10.

Figure 4:
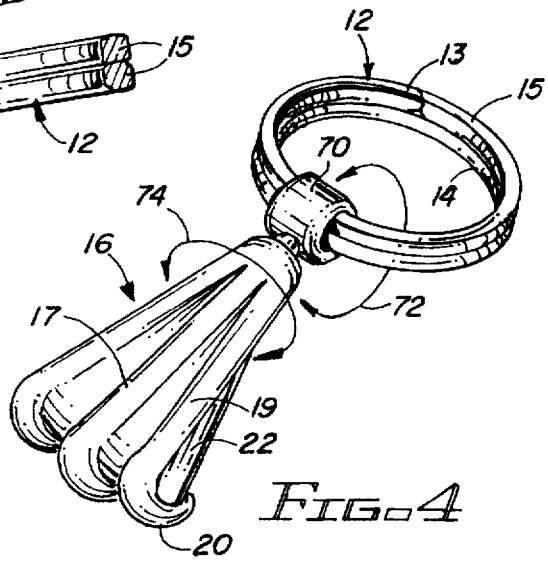
FIG. 4 is an isolated perspective view of the base ring and attaching clip of FIG. 3.

Referring to FIGS. 3 and 4, the base ring 12 and clip 16 are shown. In a preferred embodiment, the clip 16 is fitted to the base ring 12 with a collar 70 or loop so that the clip can be moved about the ring as well as rotated in the direction of the arrows 72 in FIGS. 3 and 4. Further, it is preferable that the clip 16 be able to swivel so as to rotate in the direction of the arrows 74, as indicated in FIGS. 3 and 4. This helps to prevent the cords 30, extending from the base ring 12, from becoming entangled when the clip 16 is manipulated to attach and detach the device 10 on the golf bag 100. A swivel fitting is best shown in FIG. 3, wherein a pin 78 extends through the base 18 of the clip 16 and to the collar 70 which fits about the base ring 12. The base 18 of the clip 16 is able to rotate about the shank 80 of the pin, and is retained thereon by an enlarged head 82. An opposite enlarged head 84 of the pin 78 maintains attachment of the pin to the collar 70.

Referring to FIG. 2, the present invention further provides article attachment means 90 on the base ring 12 for releasably attaching various articles such as hats, gloves, and the like to the device 10 so that the articles remain secured on the golf bag 100. In a preferred embodiment, the article attachment means 90 includes one or more alligator clips 92 fitted to the base ring 12 with suitable hardware 96. The alligator clip 92 includes opposite, opposing jaw members 97, 98 which are biased towards one another. Upon squeezing the legs 99 of the alligator clip 92, the jaws 97, 98 are separated to permit an article, such as the bill of a hat, or a glove to be placed therebetween. Upon releasing the arms 99 of the alligator clip 92, the jaws 97, 98 grasp the article to retain the article in attached relation on the device 10 so that the article hangs on an exterior of the golf bag 100.

While the instant invention has been shown and described in what is considered to be preferred and practical embodiments thereof, it is recognized that departures may be made within the spirit and scope of the invention which, therefore, should not be limited except as set forth in the following claims and within the doctrine of equivalents.

Now that the invention has been described,

What is claimed is:

1. A device for use on a golf bag having a plurality of golf clubs therein and head covers on at least some of the golf clubs, said device comprising:

a base ring, clip means fitted to said base ring for removably attaching the device to the golf bag, a plurality of generally elongate cords each having a proximal end zone, a distal end zone, and a central zone extending between the proximal and distal end zones, securing means on said proximal end zones of said cords for securing said cords to said base ring in movable relation thereon so that said securing means and said proximal end zones are able to travel about said base ring, hook means on said distal end zones of said cords for removable attachment to individual respective ones of the head covers, and wherein the head covers, when removed from the golf clubs, remain interconnected to said device and the golf bag so that they do not become separated therefrom.

2. A device as recited in claim 1 wherein said cords are formed of an elastomeric material allowing said cords to be stretched from a relaxed length to an extended length under tension.

3. A device as recited in claim 1 wherein said securing means on said proximal end zones of said cords includes swivel means for allowing said cords to spin relative to said securing means and said base ring without imparting a twist to said cords.

4. A device as recited in claim 3 wherein said hook means on said distal end zones of said cords includes shield means to protectively conceal a free distal end of said hook means.

5. A device as recited in claim 4 further including at least one cord with said hook means on both a distal end zone and a proximal end zone thereof.

6. A device as recited in claim 1 further including article attachment means on said base ring for releasably attaching a hat, glove, or like article thereto.

7. A device as recited in claim 6 wherein said article attachment means includes an alligator clip.

8. A device as recited in claim 1 wherein said clip means includes a swivel fitting for allowing said clip means to spin relative to said base ring.

9. A device as recited in claim 8 wherein said clip means is movably fitted to said base ring, allowing said clip means to rotate about said base ring.

10. A device as recited in claim 1 wherein said hook means is removably attachable to head covers on golf clubs including woods, irons, and putters.

11. A device for use on a golf bag having a plurality of golf clubs therein and head covers on at least some of the golf clubs, said device comprising:

a base ring, clip means fitted to said base ring for removably attaching the device to the golf bag, a plurality of generally elongate cords formed of an elastomeric material and each having a proximal end zone, a distal end zone, and a central zone extending between said proximal and distal end zones, said cords being structured to stretch from a relaxed length to an extended length under tension, means on said proximal end zones of said cords for securing said cords to said base ring in movable relation thereon, hook means on said distal end zone of said cords for removable attachment to individual respective ones of the head covers, swivel means at said proximal end zone and said distal end zone of each of said cords for allowing said cords to spin relative to the head covers and the base ring and golf bag without imparting a twist to said cords, and wherein the head covers, when removed from the golf clubs, remain interconnected to said device and the golf bag so that they do not become separated therefrom.

12. A device as recited in claim 11 wherein said hook means on said distal end zones of said cords includes shield means to protectively conceal a free distal end of said hook means.

13. A device as recited in claim 11 further including at least one cord with said hook means on both a distal end zone and a proximal end zone thereof.

14. A device as recited in claim 11 further including article attachment means on said base ring for releasably attaching a hat, glove or other like article thereto.

15. A device as recited in claim 14 wherein said article attachment means includes an alligator clip.

16. A device as recited in claim 11 wherein said clip means includes a swivel fitting for allowing said clip means to spin relative to said base ring.

17. A device as recited in claim 16 wherein said clip means is movably fitted to said base ring, allowing said clip means to rotate about said base ring.

18. A device as recited in claim 11 wherein said hook means is removably attachable to head covers on golf clubs including woods, irons, and putters.

* * * * *